US006905552B2

(12) United States Patent
Fassler et al.

(10) Patent No.: US 6,905,552 B2
(45) Date of Patent: Jun. 14, 2005

(54) CONTACTLESS CLEANING OF VERTICAL INK JET PRINTHEADS

(75) Inventors: Werner Fassler, Rochester, NY (US); Marcello Fiscella, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 142 days.

(21) Appl. No.: 10/324,377

(22) Filed: Dec. 19, 2002

(65) Prior Publication Data

US 2003/0121531 A1 Jul. 3, 2003

Related U.S. Application Data

(60) Provisional application No. 60/342,209, filed on Dec. 26, 2001.

(51) Int. Cl.[7] ..... B08B 7/00

(52) U.S. Cl. ..... 134/6; 347/22; 347/27; 347/29; 347/25; 347/28; 347/30; 347/32; 134/32; 134/34; 134/42; 134/166 R; 134/169 R; 134/184

(58) Field of Search ..... 347/22, 27, 29, 347/32, 25, 28, 30; 134/6, 32, 34, 42, 166 R, 169 R, 184

(56) References Cited

U.S. PATENT DOCUMENTS 4,011,157 A * 3/1977 Pennebaker et al. ..... 210/718
5,997,127 A * 12/1999 Fassler et al. ..... 347/28
6,047,715 A * 4/2000 Mooney et al. ..... 134/122 R
6,281,909 B1 * 8/2001 Fassler et al. ..... 347/28
6,350,007 B1 * 2/2002 Meichle et al. ..... 347/29
6,511,155 B1 * 1/2003 Fassler et al. ..... 347/35
6,592,201 B2 * 7/2003 Sharma et al. ..... 347/28
6,726,304 B2 * 4/2004 Fassler et al. ..... 347/28
2003/0121531 A1 * 7/2003 Fassler et al. ..... 134/6

FOREIGN PATENT DOCUMENTS

EP 0988978 A1 * 3/2000
EP 0992355 A2 * 4/2000

OTHER PUBLICATIONS

Co–pending U.S. Appl. No. 09/935,495, entitled "Cleaning Ink Jet Printheads and Orifices," by Werner Fassler et al., filed Aug. 23, 2001.

* cited by examiner

*Primary Examiner*—Sharidan Carrillo
(74) *Attorney, Agent, or Firm*—David J. Arthur

(57) ABSTRACT

A cleaning station for a vertical nozzle plate of an ink jet printer includes a cylindrical cleaning roller that has an outer surface, and has a substantially vertical central axis and a substantially vertical rotational axis. The roller is spaced from the nozzle plate to form a cleaning cavity between the roller and the nozzle plate. The roller has a top end above the nozzle plate and a bottom end below the nozzle plate. A drive element is connected to the roller to rotate the roller about its rotation axis. A fluid outlet near the top of the roller directs cleaning fluid onto the outer surface of the roller, and into the cleaning cavity between the roller and the nozzle plate. A fluid reservoir stores cleaning fluid, and a fluid conduit conducts cleaning fluid from the fluid reservoir to the fluid outlet.

14 Claims, 3 Drawing Sheets

CONTACTLESS CLEANING OF VERTICAL INK JET PRINTHEADS

BACKGROUND

This application is based on a Provisional Patent Application No. 60/342,209, filed Dec. 26, 2001.

This invention relates to cleaning debris from orifices in an ink jet printhead nozzle plate. In particular, this invention relates to cleaning a vertically oriented nozzle plate.

Many different types of digitally controlled printing systems of ink jet printing apparatus are presently being used. These ink jet printers use a variety of actuation mechanisms, a variety of marking materials, and a variety of recording media. For home applications, digital ink jet printing apparatus is often the printing system of choice because low hardware cost makes the printer widely affordable. Another application for digital ink jet printing uses large format printers. These large format printers are expected to provide low cost copies with an ever improving quality. Ink jet printing technology is the first choice in today's art. Thus, there is a need for improved ways to make digitally controlled graphic arts media, such as billboards, large displays, and home photos, for example, so that quality color images may be made at a high-speed and low cost, using standard or special paper.

Ink jet printing has become recognized as a prominent contender in the digitally controlled, electronic printing arena because of its non impact, low-noise characteristics, its use of papers from plain paper to specialized high gloss papers and its avoidance of toner transfers and fixing. Ink jet printing mechanisms can be categorized as either continuous ink jet or droplet on demand ink jet.

Continuous ink jet printing generally involves using electric charge to selectively direct a stream of ink droplets. On demand type ink jet printers selectively produce individual ink droplets at each of many ink jet orifices. A typical consumer type printer includes approximately 30 to 200 orifices on the nozzle plate. At every orifice, a pressurization actuator is used to produce the ink jet droplet. Typical on demand ink jet printers use one of two types of actuators to produce the ink jet droplet. The two types of actuators are heat and piezo materials. With a heat actuator, a heater at a convenient location heats ink and a quantity of the ink will phase change into a gaseous steam bubble and raise the internal ink pressure sufficiently for an ink droplet to be expelled to a suitable receiver. The piezo ink actuator incorporates a piezo material. Material is said to possess piezo electric properties if an electric charge is produced when a mechanical stress is applied. This is commonly referred to as the "generator effect." The converse also holds true, in that an applied electric field will produce a mechanical stress in the material. This is commonly referred to as the "motor effect."

Inks for high speed jet droplet printers have a number of special characteristics. Typically, water-based inks have been used because of their conductivity and viscosity range. For use in a jet droplet printer, preferred inks are electrically conductive, having a resistivity below about 5000 ohm-cm and preferably below about 500 ohm-cm. For good flow through small orifices, water-based inks generally have a viscosity in the range between about 1 to 15 centipoise at 25 degree C. Preferred inks additionally are stable over a long period of time, compatible with the materials comprising the nozzle plate and ink manifold, free of living organisms, and functional after printing. Preferred after printing characteristics are smear resistance after printing, fast drying on paper, and waterproof when dry. An ideal ink also incorporates a nondrying characteristic in the jet cavity so that the drying of ink in the cavity is hindered or slowed to such a degree that through occasional spitting of ink droplets the cavities can be kept open. The addition of glycol will facilitate the free flow of ink through the ink jet. Also it is of benefit if ink additives prevent the ink from sticking to the ink jet printhead surfaces.

Ink jet printing apparatus typically includes an ink jet printhead that is exposed to the various environments where ink jet printing is utilized. The orifices are exposed to all kinds of air borne particles. Particulate debris accumulates on the printhead surfaces, forming around the orifices. The ink may combine with such particulate debris to form an interference burr to block the orifice or cause through an altered surface wetting to inhibit a proper formation of the ink droplet. That particulate debris has to be cleaned from the orifice to restore proper droplet formation. This cleaning commonly is achieved by wiping, spraying, vacuum suction, and/or spitting of ink through the orifice. Wiping is the most common cleaning technique.

SUMMARY

The present invention provides improved cleaning of a vertical nozzle plate of an ink jet printhead. The invention provides cleaning of an ink jet printing apparatus wherein the cleaning liquid can be effectively used to provide for improved cleaning with a minimum number of parts and operations. The present invention provides for non-contacting cleaning of particulate debris, thereby eliminating the need of traditional wiper blades or other mechanical contact methods.

In accordance with one aspect of the contactless cleaning of a vertical nozzle plate, the apparatus includes a reservoir for containing cleaning fluid, and a cleaning cavity adjacent the nozzle plate. An upper fluid outlet above the cleaning cavity directs fluid into the cleaning cavity, and the conduit conducts cleaning fluid from the reservoir to the upper fluid outlet. In particular implementation, the apparatus includes an agitator for agitating fluid in the cleaning cavity. The agitator is positioned a small distance from the nozzle plate, with the distance between the agitator and the nozzle plate defining the cleaning cavity. In a further particular implementation, the agitator is a roller having a substantially vertical rotation axis.

A method of cleaning a vertical nozzle plate for an ink jet printer includes cascading cleaning fluid along the nozzle plate, and agitating the cleaning fluid against the nozzle plate. In a particular implementation described, cascading the cleaning fluid along the nozzle plate includes positioning an agitator near the nozzle plate, and cascading cleaning fluid along the outer surface of the agitator. Agitating the cleaning fluid against the nozzle plate in this particular implementation includes moving the agitator relative to the nozzle plate, such as by rotating the agitator about a rotation axis that is substantially parallel to the nozzle plate.

DETAILED DESCRIPTION

Figure 1:
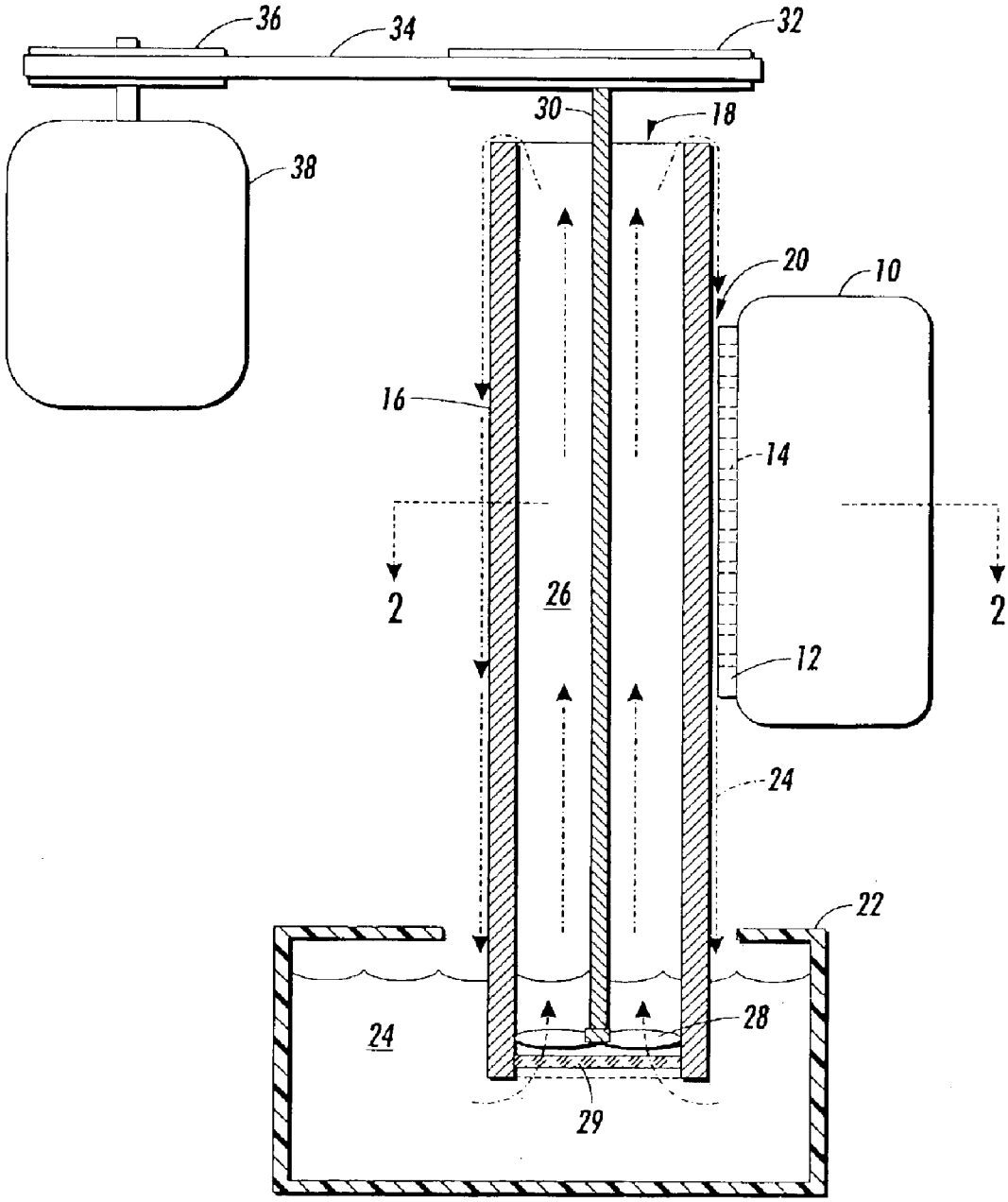
FIG. 1 is a cross-sectional view of one embodiment of an ink jet printer cleaning station in accordance with an aspect of the present invention.
Figure 2:
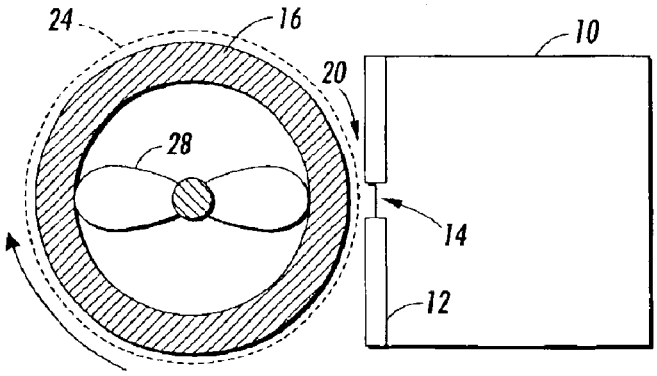
FIG. 2 is a cross-sectional view of the cleaning station taken along line 2—2 of FIG. 1.

FIG. 1 shows a cross sectional view of a cleaning station of an ink jet printer. The printer includes a printhead 10 with a nozzle plate 12. Many orifices 14 extend through the nozzle plate 12. The printhead 10 includes a manifold and capillary tubes (not shown) for delivering ink to each orifice 14. The printhead selectively ejects droplets of ink from the orifices 14. The construction of such ink jet printheads is well understood by persons familiar with the art.

The printhead is a vertical printhead (i.e., the nozzle plate 12 of the printhead is substantially vertical). In the embodiment illustrated, the nozzles 14 are arranged in a substantially vertical arrangement on the vertical nozzle plate. FIG. 1 shows one column of nozzles. Those skilled in the art will recognize that such a nozzle plate typically includes additional columns of nozzles. Those skilled in the art will also recognize that other arrangements of nozzles on the vertical nozzle plate are also possible, including horizontal arrays of nozzles.

The cleaning station includes a structure to permit cleaning fluid to cascade along the face of the nozzle plate 12. The structure includes an agitator to agitate the cleaning fluid as it cascades along the face of the nozzle plate. In the illustrated embodiment, this structure includes a substantially cylindrical cleaning roller 16 and an upper fluid outlet 18. The cleaning roller 16 has its outer surface spaced a small distance from the face of the nozzle plate 12 to form a cleaning cavity 20 between the surface of the roller 16 and the face of the orifice plate 12. The top end of the roller 16 is at or above the top of the nozzle plate 12, and the bottom end of the roller is at or below the bottom edge of the nozzle plate. The cleaning roller has a substantially vertical central axis, and a substantially vertical rotational axis. In the embodiment illustrated in FIG. 1, the central axis and the rotational axis of the roller are coincident.

The cleaning roller 16 is formed of any material that is compatible with the cleaning solutions to be used in cleaning the printhead. Suitable materials that do not significantly deteriorate in the presence of many cleaning fluids include anodized aluminum, and certain hard rubbers and plastics.

The upper fluid outlet 18 directs fluid into the cleaning cavity 20 between the roller surface and the nozzle plate. A reservoir 22 stores cleaning fluid 24 for use by the cleaning apparatus. In the particular embodiment illustrated, the cleaning fluid reservoir 22 is located at the bottom of the roller 16. Many types of cleaning fluid can be used. For example, the cleaning fluid may be the same as a colorless ink base without the dye or pigment.

A cleaning fluid conduit 26 extends from the reservoir 22 to the upper fluid outlet 18 to supply cleaning fluid from the reservoir to the upper fluid outlet. In the embodiment illustrated, the agitator cleaning roller 16 is hollow, and the fluid conduit 26 is through the interior of the cleaning roller. In this embodiment, the upper fluid outlet 18 is an open upper end of the hollow roller 16. The bottom end of the roller is also open to receive cleaning fluid from the reservoir 22. Other arrangements for the reservoir, fluid conduit, and upper fluid outlet will also be apparent. For example, the reservoir may be located near the top of the cleaning structure. The fluid conduit may be separate from the cleaning roller. The upper fluid outlet 18 may also be directionally oriented (such as with a nozzle) to direct cleaning fluid specifically toward the cleaning cavity 20.

An impeller 28 propels or moves fluid from the reservoir 22 through the fluid conduit 26 to the upper fluid outlet 18 at the top of the roller. In the embodiment illustrated in FIG. 1, the impeller 28 is at or near the bottom of the cleaning roller to draw fluid from the reservoir. The impeller is integrally formed with, or securely attached to, the outer wall of the hollow cylindrical cleaning roller. Thus, as the cleaning roller 16 is rotated, the impeller 28 rotates at the same rate, to draw fluid from the reservoir up through the fluid conduit. Those skilled in the art will appreciate that the impeller 28 may be separated from the cleaning roller, and be separately driven, whether at the same rate as the cleaning roller, or at a different rate.

A filter 29 in the fluid conduit 26 prevents debris or other particles that may be in the cleaning fluid 24 from flowing out the upper fluid outlet.

The roller 16 agitates cleaning fluid 24 at the face of the nozzle plate 12 as the cleaning fluid cascades through the cleaning cavity 20. In one particular implementation, the roller 16 agitates the cleaning fluid by rotating about the roller's rotation axis. Such rotation aids in circulating the cleaning fluid across the face of the nozzle plate. As the cleaning fluid cascades along the outer surface of the cleaning roller 16, the cleaning fluid contacts the face of the nozzle plate 12. Rotation of the cleaning roller and capillary forces help the cleaning fluid fill the gap between the surface of the cleaning roller and the face of the nozzle plate. In addition, rotation of the cleaning roller induces turbulence into the cleaning fluid in the gap, which aids in cleaning the face of the nozzle plate, and also of cleaning the orifices 14 in the nozzle plate. Those skilled in the art will recognize many mechanisms are available for rotating the cleaning roller. For example, the cleaning roller may include a central axle 30. One end of the axle is attached to a pulley wheel 32, which is driven by a belt 34 from a drive pulley 36 attached to a motor 38. The cleaning roller 16 may also be driven directly from a motor. Alternatively, a motor may drive a pulley arrangement or a gear arrangement formed on or attached to the outer surface of the cleaning roller. Contactless driving arrangements, such as magnetic couplings, are also known.

Figure 3:
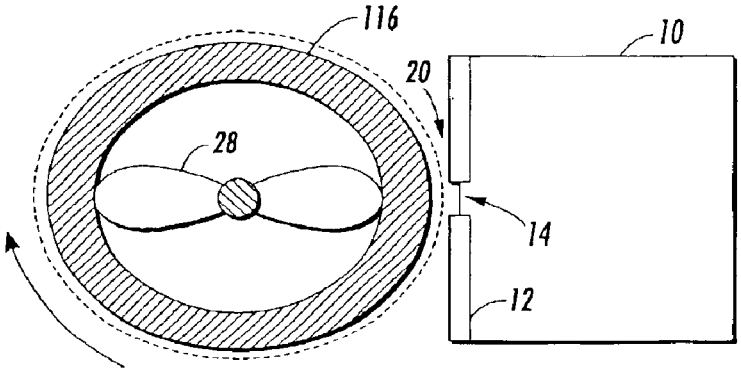
FIG. 3 is a cross-sectional view of a second embodiment of the cleaning station.
Figure 4:
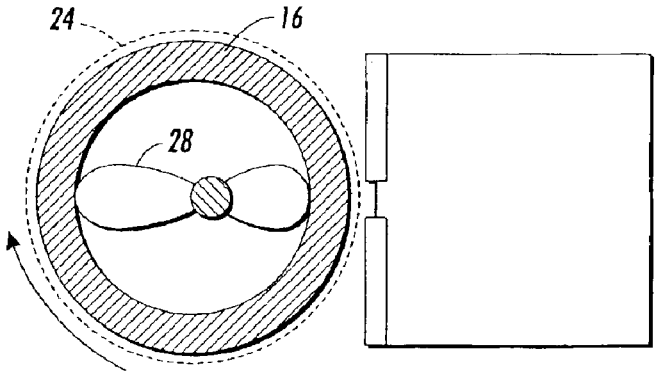
FIG. 4 is a cross-sectional view of a third embodiment of the cleaning station.

Thus, the cleaning station causes only fluid to contact the face of the nozzle plate 12 to clean the face of the nozzle plate, so that hard and potentially damaging cleaning elements do not contact the face of the nozzle plate 12. Those skilled in the art will recognize that various modifications can be made to the structure described above. For example, other structures can be used to enhance the agitation of the cleaning fluid against the face of the nozzle plate 12. Referring to the embodiment illustrated in FIG. 3, the cleaning roller 116 has an eccentric cross-sectional shape, so that the spacing of the gap between the surface of the roller 116 and the face of the nozzle plate 12 varies as the roller 116 rotates. Another embodiment illustrated in FIG. 4 has an off-center rotational axis for the cylindrical cleaning roller 16. The off-center rotational axis causes the gap between the surface of the cleaning roller 16 and the face of the nozzle plate 12 to vary as the cleaning roll 16 rotates. Those skilled in the art will recognize that other arrangements, such as pulsating or vibrating elements may be used in addition to, or in lieu of, the cleaning roller 16 to enhance the agitation of the cleaning fluid in the gap adjacent the face of the nozzle plate 12.

Figure 5:
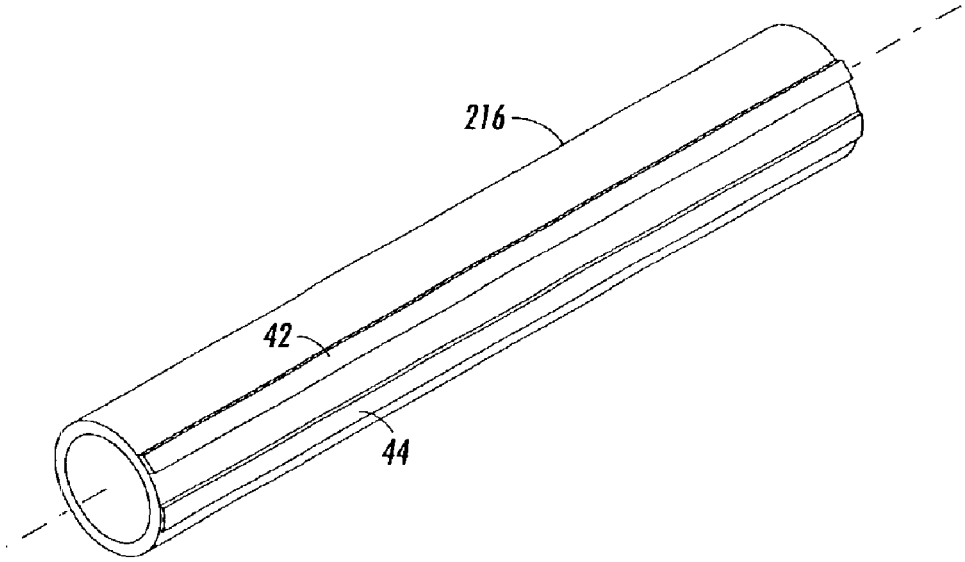
FIG. 5 shows an exemplary surface configuration for the roller of the cleaning station.

In another arrangement, the outer surface of the cleaning roller 16 may be configured to enhance the agitation of the cleaning fluid against the face of the nozzle plate 12. Referring to FIG. 5, the surface of the cleaning roller 16 may be formed with strips of hydrophobic material 42 and strips of hydrophilic material 44. Such strips of hydrophobic and hydrophilic surface structures alter the characteristics of the fluid flow as the fluid cascades along the surface of the cleaning roller 16 and the cleaning roller rotates.

Referring again to FIG. 1, when cleaning of the nozzle plate 12 is desired, the nozzle plate 12 is brought into the cleaning station, adjacent the cleaning roller 16. The printhead 10 is positioned so that the nozzle plate 12 is spaced with a small gap between the face of the nozzle plate 12 and the surface of the cleaning roller 16. The cleaning station may also translate to bring the agitator and cleaning roller 16 into proximity with the nozzle plate. The motor 38 is engaged to rotate the cleaning roller 16 and its embedded impeller 28 to draw cleaning fluid 24 from the reservoir 22 through the conduit 26 to the upper fluid outlet 18. From the upper fluid outlet 18, the fluid cascades along the surface of the cleaning roller 16, flowing through the cleaning cavity 20 between the surface of the cleaning roller 16 and the face of the nozzle plate 12. As noted above, the rotation of the cleaning roller 16 helps to agitate the cleaning fluid in the cleaning cavity 20, enhancing the cleaning capabilities of the cleaning fluid against the face of the nozzle plate 12. The cleaning fluid then falls back to the reservoir 22. The filter 29 prevents debris from flowing into the conduit 26 back to the upper fluid outlet.

The agitator and/or rotation of the cleaning roller can be varied to match the optimum cleaning action for each particular ink.

Given the principles described above, those skilled in the art will recognize that various structures other than the embodiments specifically illustrated and described above are possible. Therefore, the scope of the present invention is defined by the following claims, and the above detailed description of particular implementations of the invention do not limit the scope of the invention as defined.

We claim:

1. A method of cleaning a vertical nozzle plate of an ink jet printer, the method comprising:

cascading cleaning fluid along the nozzle plate; and agitating the cleaning fluid against the nozzle plate.

2. The method of claim 1, wherein:

cascading cleaning fluid along the nozzle plate comprises:

positioning an agitator near the nozzle plate; and cascading cleaning fluid along the outer surface of an agitator spaced from the nozzle plate; and agitating the cleaning fluid against the nozzle plate comprises moving the agitator relative to the nozzle plate.

3. The method of claim 1, wherein cascading cleaning fluid along the nozzle plate comprises allowing the cleaning fluid to flow in a substantially vertical direction past a plurality of nozzles in the nozzle plate.

4. The method of claim 2, wherein moving the agitator relative to the nozzle plate comprises rotating the agitator about a rotation axis substantially parallel to the nozzle plate.

5. The method of claim 3, wherein agitating the cleaning fluid against the nozzle plate comprises moving an agitator having a substantially vertical agitator surface.

6. The method of claim 4, wherein cascading cleaning fluid along the outer surface of the agitator comprises:

directing cleaning fluid out of a fluid outlet near the top of the agitator;

collecting cleaning fluid in a reservoir near the bottom of the agitator; and directing cleaning fluid from the reservoir to the fluid outlet.

7. The method of claim 5, wherein moving the agitator comprises rotating a roller about a substantially vertical axis.

8. The method of claim 6, wherein positioning an agitator near the nozzle plate comprises moving the nozzle plate into proximity with the agitator.

9. A method of cleaning a nozzle plate of an ink jet printer, wherein the nozzle plate is oriented substantially vertically, the method comprising:

flowing cleaning fluid against an upper portion of the printhead;

allowing the cleaning fluid to flow in a substantially vertical direction past a plurality of nozzles in the nozzle plate; and agitating the cleaning fluid against the nozzle plate as the cleaning fluid flows in the substantially vertical direction.

10. The method of claim 9, wherein allowing the cleaning fluid to flow in the substantially vertical direction comprises allowing the cleaning fluid to flow substantially downward.

11. The method of claim 9, wherein agitating the cleaning fluid comprises rotating a roller about a substantially vertical axis.

12. The method of claim 10, wherein allowing the cleaning fluid to flow substantially downward comprises allowing the cleaning fluid to flow downward along the outer surface of an agitator, wherein the outer surface of the agitator is spaced from the nozzle plate.

13. The method of claim 12, wherein agitating the cleaning fluid against the nozzle plate comprises moving the outer surface of the agitator relative to the nozzle plate.

14. The method of claim 13, wherein moving the outer surface of the agitator comprises rotating the agitator about a substantially vertical axle.

* * * * *